US006057534A

United States Patent [19]

Lee

[11] Patent Number: 6,057,534

[45] Date of Patent: May 2, 2000

[54] DOOR FOR A MICROWAVE OVEN HAVING A KNOB PART CONVENIENT TO GRASP

[75] Inventor: Suk Hee Lee, Suwon, Rep. of Korea

[73] Assignee: Samsung Electronics Co., Ltd., Suwon, Rep. of Korea

[21] Appl. No.: 09/212,421

[22] Filed: Dec. 16, 1998

[30] Foreign Application Priority Data

Dec. 31, 1997 [KR] Rep. of Korea ..... 97-82439
Dec. 31, 1997 [KR] Rep. of Korea ..... 97-82442

[51] Int. Cl.[7] ..... H05B 6/76

[52] U.S. Cl. ..... 219/739; 292/347

[58] Field of Search ..... 219/739, 724, 219/741; 126/190, 191; 292/DIG. 12, DIG. 30, DIG. 69

[56] References Cited

U.S. PATENT DOCUMENTS

| | | | |
|---|---|---|---|
| 3,966,204 | 6/1976 | Dubach | 272/135 |
| 4,019,010 | 4/1977 | Tanaka et al. | 219/746 |
| 4,038,510 | 7/1977 | White | 219/712 |
| 4,412,696 | 11/1983 | Ishii et al. | 292/336.3 |
| 5,129,694 | 7/1992 | Tanimoto et al. | 292/347 |
| 5,194,549 | 3/1993 | Lear et al. | 528/44 |
| 5,446,083 | 8/1995 | Stevens et al. | 524/458 |
| 5,637,409 | 6/1997 | Stevens et al. | 428/500 |

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A door for a microwave oven has a rectangular door frame, and a transparent door screen installed on a central area of the door frame. A strip-shaped knob part is formed together with the door frame on the side opposite to a hinge part of the door frame. The door frame forms a grasping hole so as to be capable of being grasped along a plane of the door frame from both sides thereof. Since a user can grasp the knob part from both sides thereof, the door can be opened/closed conveniently without slipping in grasping the knob part. In particular, if an auxiliary pad is attached to the knob part, the knob part can be grasped with a favorable feeling and the slipping is prevented more effectively.

6 Claims, 8 Drawing Sheets

DOOR FOR A MICROWAVE OVEN HAVING A KNOB PART CONVENIENT TO GRASP

BACKGROUND OF THE INVENTION

1. Field of the Invention

The present invention relates to a door for a microwave oven, and more particularly, to a door for a microwave oven having a knob part to make it convenient to hold the door, and a user has the good feeling in holding.

2. Prior Art

In general, a microwave oven has a body forming a cooking chamber for accommodating a food to be cooked, and a door for opening/closing the cooking chamber is installed on the front side of the body. FIG. 7 shows an example of the door used in a microwave oven.

The door 101 has a door frame having a rectangular shape and being formed with an open part 106 at the central area thereof, and a rear plate 107 attached to the rear of the door frame 105. A door screen 103 made of a transparent material is disposed between the door frame 105 and the rear plate 107. A user can see the cooking status of the food accommodated in the cooking chamber through the door screen 103. Further, a blocking plate 109 for blocking microwaves is attached to the rear plate 107.

Meanwhile, a knob 111 is installed on the front side of the door frame 105. The knob 111 is disposed near the right edge of the front side of the door frame 105. A pair of screw holes 113 are formed on the door frame 105, and screws 115 are assembled to the screw holes 113 in order to fix the knob 111 to the door frame 105.

However, in such a conventional door 101 for a microwave oven, since the knob 111 is manufactured separately, an additional process for fixing the knob 111 to the door frame 105 is required. In order to overcome such a shortcoming, another type of door 151 for a microwave oven as shown in FIG. 8 has been proposed.

In the door 151 for a microwave oven shown in FIG. 8, the door frame 105 and the knob 155 are formed in a single body. Thus, the door frame 105 and the knob 155 are manufactured by a single process, and the additional process for fixing the knob 155 to the door frame 105 is not required. Furthermore, a grasping recess 157 is formed at the left side of the knob 155 which provides a user with a means for grasping the knob 155.

However, in such a conventional door 151 for a microwave oven, since the user grasps the knob 155 with the grasping recess 157 formed only at one side thereof, it is not convenient to grasp the knob 155. Furthermore, the user cannot help using only one hand of his own, usually the left hand, in order to open and close the door 151, which causes inconvenience in opening/closing the door 151. Moreover, the fingers of the user may slip when the user grasps the knob 155.

SUMMARY OF THE INVENTION

The present invention has been proposed to overcome the above-described problems in the prior art, and accordingly, it is the object of the present invention to provide a door for use in a microwave oven, which can be manufactured easily, thereby making it convenient to grasp it, and preventing slipping of fingers.

To achieve the above object, the present invention provides a door for use in a microwave oven, comprising: a door frame hingedly installed on a body forming a cooking chamber; a door screen installed on a central area of the door frame; and a knob part formed together with the door frame on one end of the door frame, the knob part forming a grasping hole so that a user can hold it anywhere along the line of the door frame from both sides thereof.

A user can grasp the knob part from both sides thereof. Therefore, it is convenient to open/close the door, the feeling of grasping is favorable, and the slipping of fingers is prevented. Furthermore, since the knob part is formed in a body with the door frame, it can be manufactured easily.

Preferably, the knob part is smoothly bent so as to be arc-shaped along a longitudinal direction thereof, whereby a door having an agreeable appearance is provided.

Furthermore, an auxiliary pad is attached to a rear side of the knob part. The auxiliary pad is made of a rubber or a silicon. The auxiliary pad functions to provide a favorable feeling in grasping the knob part.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
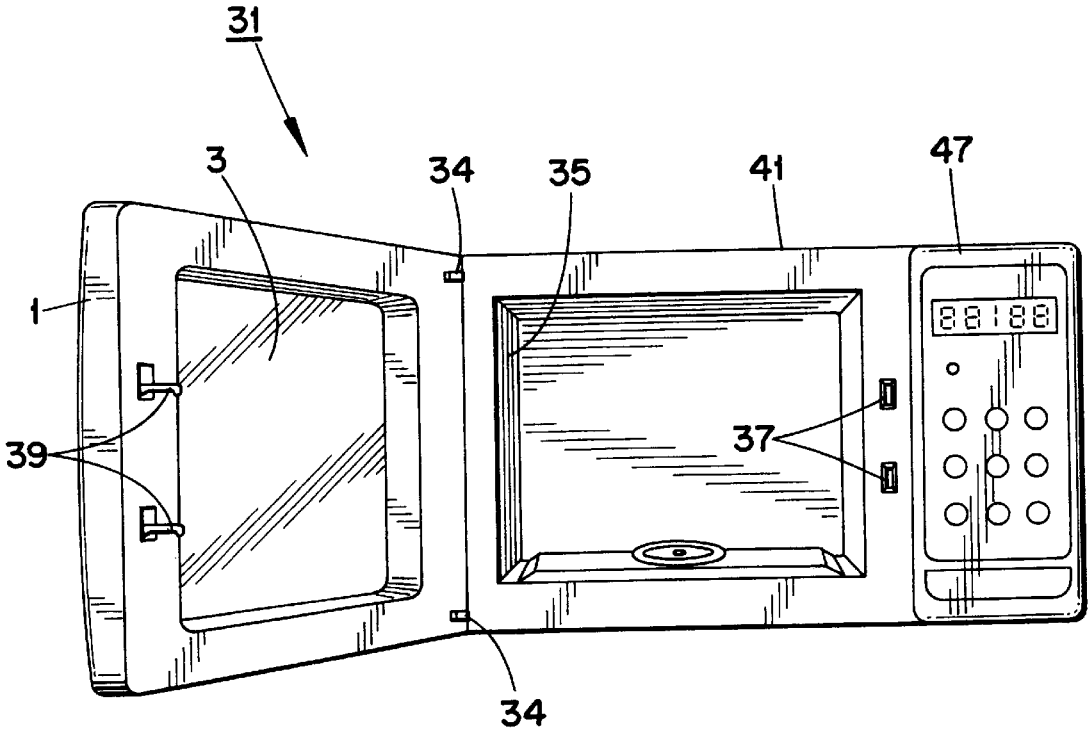
FIG. 1 is a front view of a microwave oven in which a door according to the present invention is employed.
Figure 2:
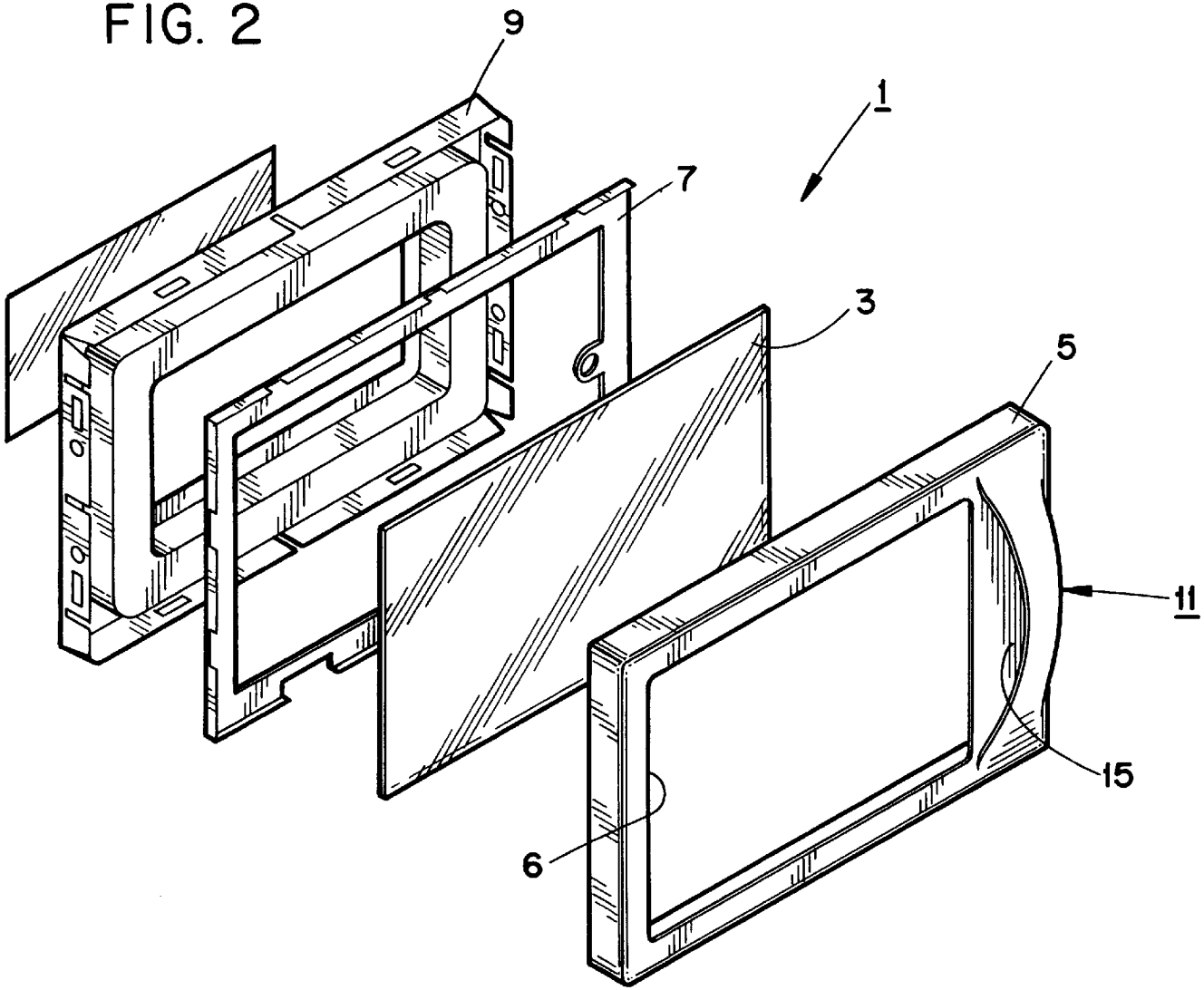
FIG. 2 is an exploded perspective view of a door shown in FIG. 1.
Figure 3:
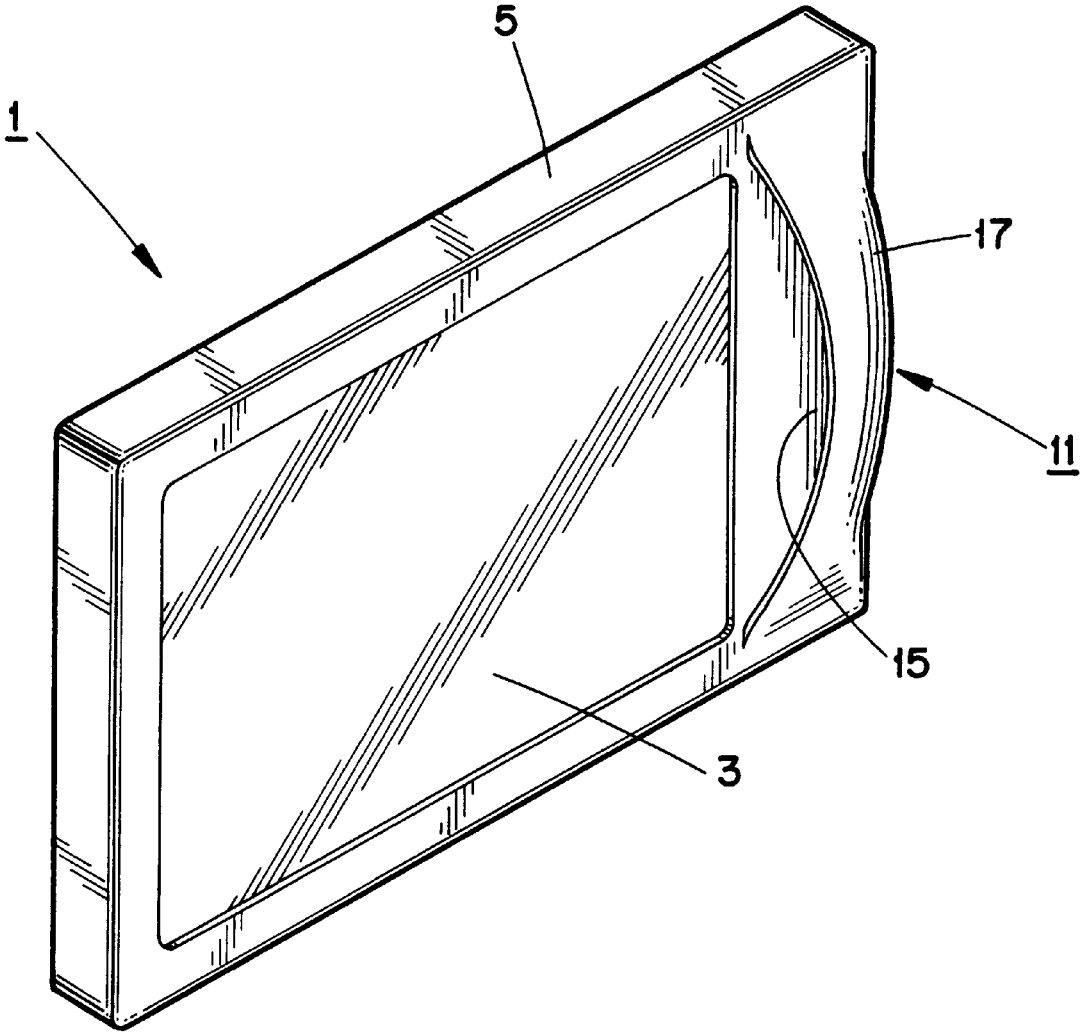
FIG. 3 is a perspective view of the assembled state of FIG. 2.
Figure 4:
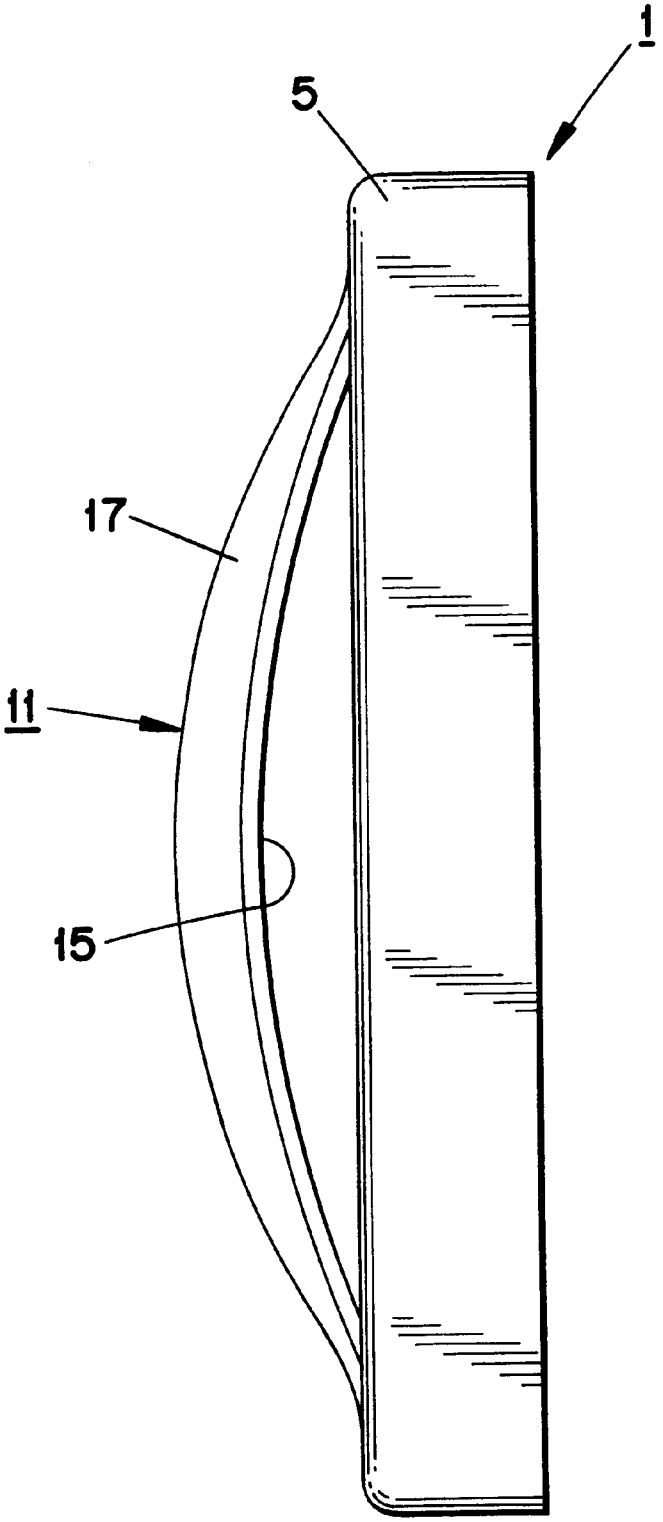
FIG. 4 is a side view of FIG. 3.

FIG. 1 shows a microwave oven in which a door according to the present invention is employed, and FIGS. 2 through 4 show a door for use in a microwave oven according to the present invention.

The microwave oven 31 has a body 41 forming a cooking chamber 35 for accommodating the food to be cooked, and a door 1 installed on the front side of the body 41 so as to open/close the cooking chamber 35. The door 1 is assembled to the body 41 by a pair of hinges 34. On the right part of the front side of the body 41, a control panel 47 for controlling the operation of the microwave oven 31 is installed.

On the inner side of the door 1 are installed hooks 39, and on the front side of the body 41 are formed hooking holes 37 corresponding to the hooks 39, respectively. When a user closes the door 1, the hooks 39 are engaged with the hooking holes 37, whereby the cooking chamber 35 is closed by the door 1.

The door 1 has a door frame 5 having a rectangular shape and being formed with an open part 6 at the central area thereof, and a rear plate 7 attached to the rear of the door frame 5. A door screen 3 made of a transparent material is disposed between the door frame 5 and the rear plate 7. A user can see the status of the food to be cooked in the cooking chamber 35 through the door screen 3. Further, a blocking plate 9 for blocking microwaves is attached to the rear plate 7.

Meanwhile, a knob part 11 is formed on the door frame 5. The knob part 11 is disposed vertically near the right edge of the front side of the door frame 5, and is formed together with the door frame 5 in a single body. The door frame 5 and the knob part 11 are manufactured by a single process, and therefore, the additional process for fixing the knob part 11 to the door frame 5 is not required.

The knob part 11 has the shape of a strip, so a user can grasp it from both sides thereof along the plane of the door frame 5. More specifically, the central portion of the knob part 11 is spaced from the door frame 5 to form a grasping hole 15. The user can grasp the knob part 11 through the grasping hole 15 from the left or the right of the knob part 11. Thus, the user can open/close the door 1 conveniently with any one of his hands. Furthermore, since the user can grasp the knob part 11 by passing his fingers through the grasping hole 15, no slipping of fingers occurs.

The knob part 11 is bent smoothly so as to be arc-shaped along the longitudinal direction thereof, and the left edge thereof protrudes to be higher than the right edge thereof. Further, the outer surface 17 of the knob part 11 is smoothly bent so that it has a shape of a partial dome. Therefore, the knob part 11 provides an agreeable appearance, and favorable feeling in grasping.

Figure 5:
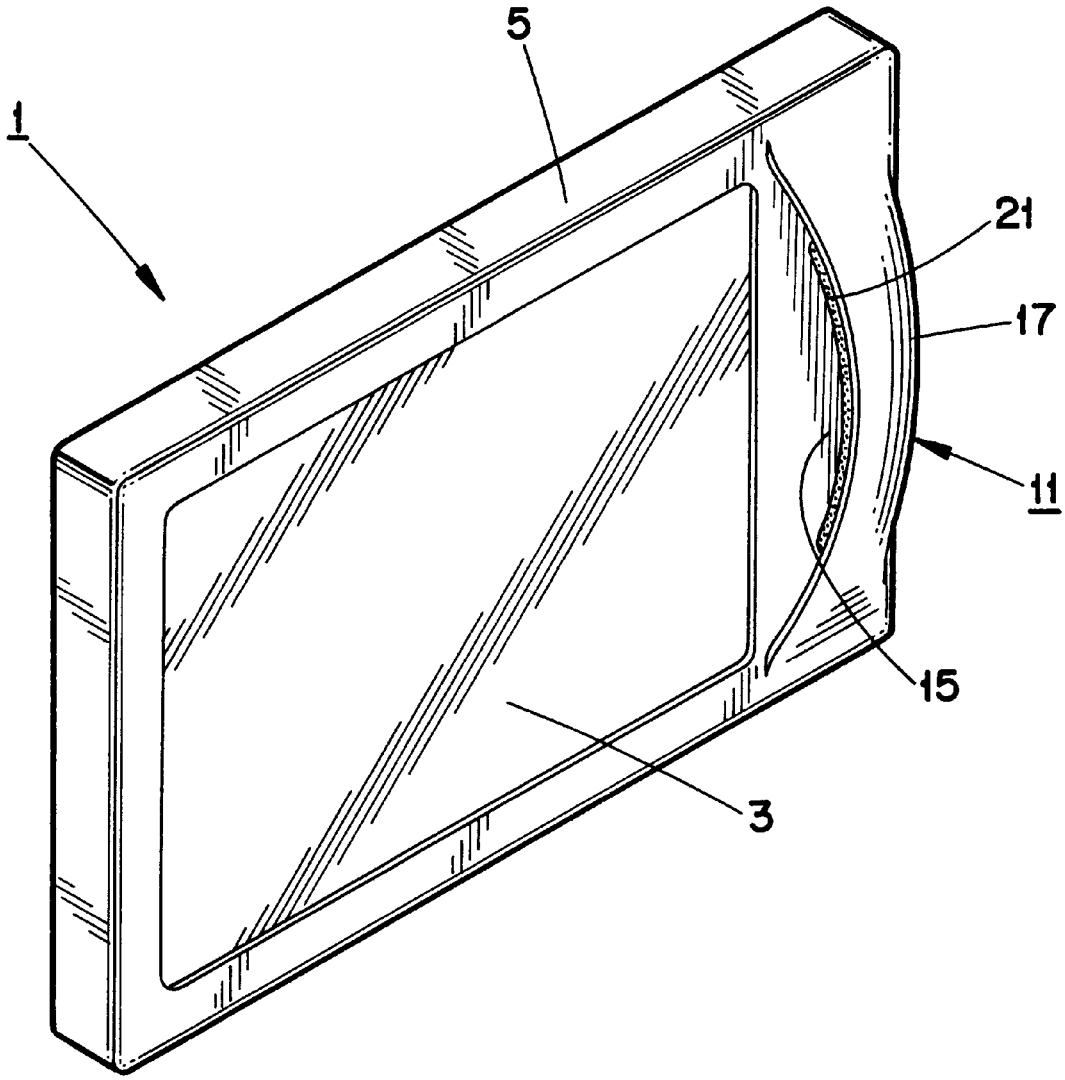
FIG. 5 is a perspective view of a door for use in a microwave oven according to another embodiment of the present invention.
Figure 6:
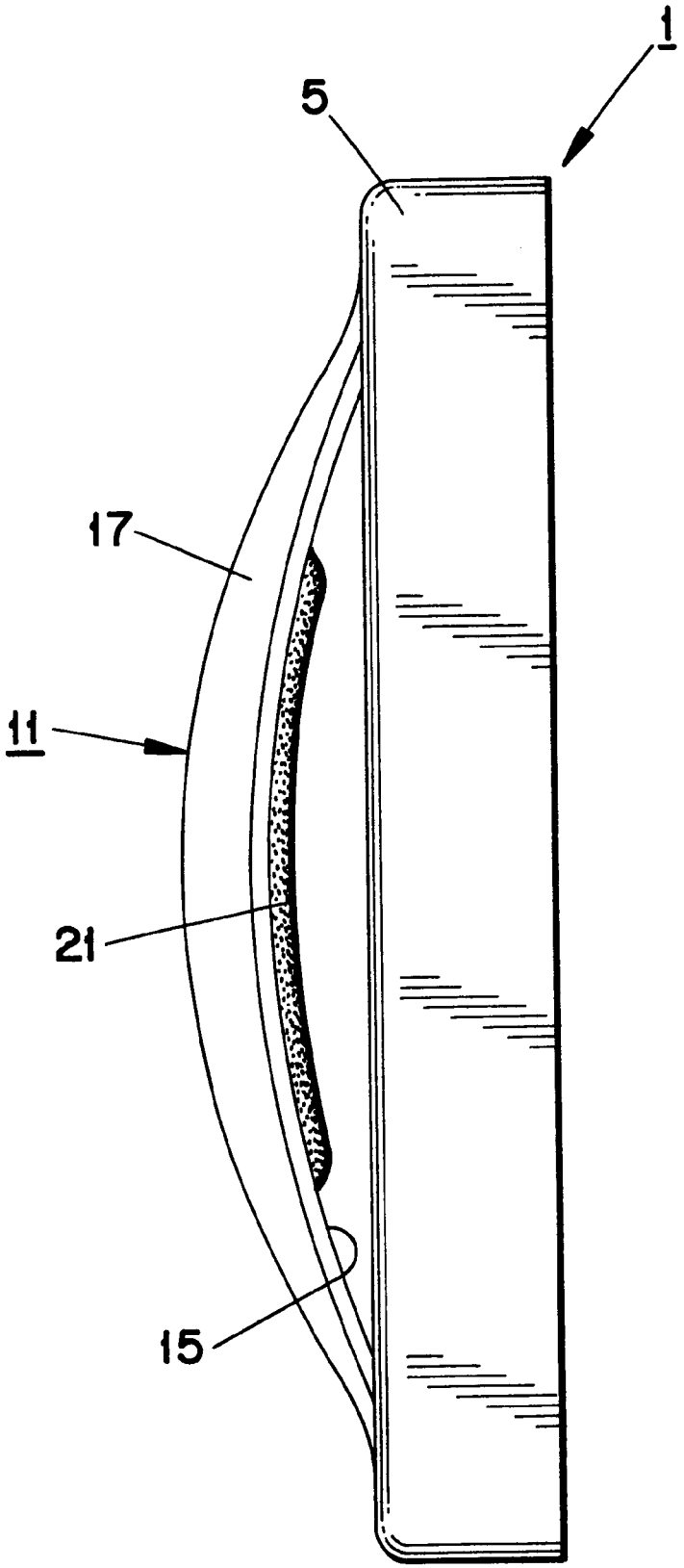
FIG. 6 is a side view of FIG. 5.
Figure 7:
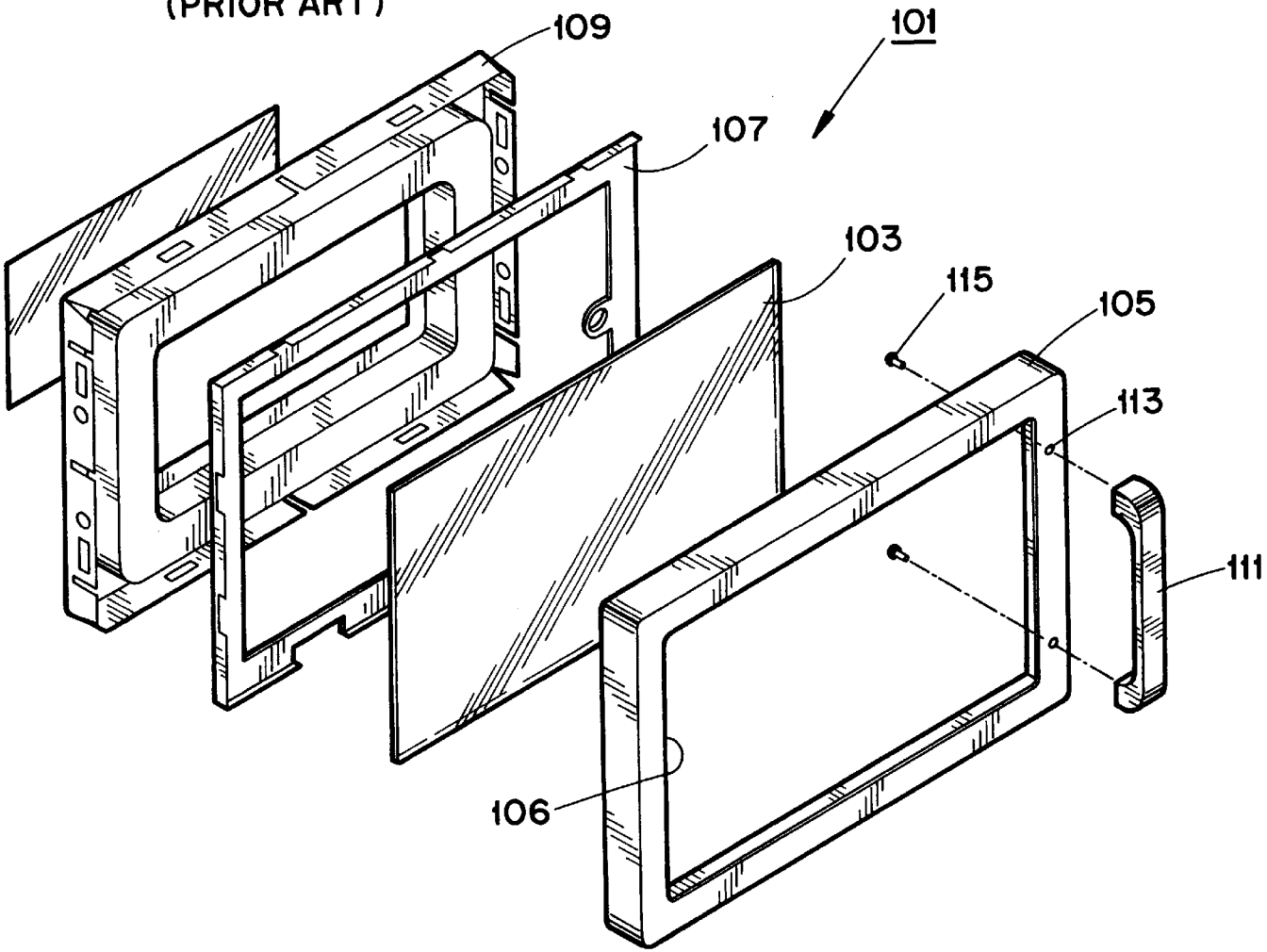
FIG. 7 (PRIOR ART)
FIG. 7 is an exploded perspective view showing an example of a conventional door for a microwave oven.
Figure 8:
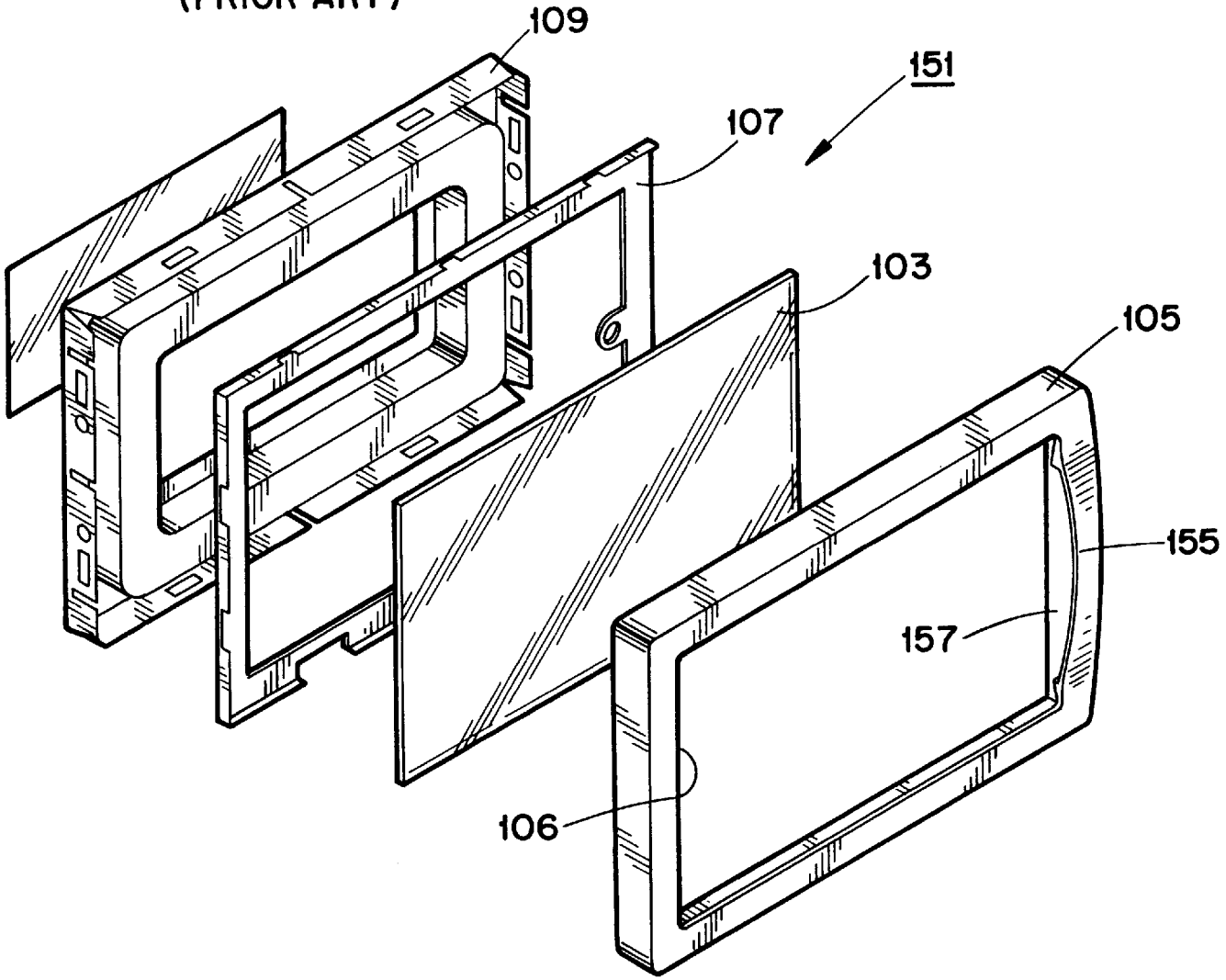
FIG. 8 (PRIOR ART)
FIG. 8 is an exploded perspective view showing another example of a conventional door for a microwave oven.

FIGS. 5 and 6 show a door for a microwave oven according to another embodiment of the present invention. In FIGS. 5 and 6, parts identical to those in the above-described embodiment are referred to with the same reference numerals. In the present embodiment, the construction of parts other than an auxiliary pad 21 is the same as in the above-described embodiment. That is, the knob part 11 is formed together with the door frame 5, and has the shape of a strip forming a grasping hole 15, so a user can grasp it from both sides thereof.

The auxiliary pad 21 is attached to the inner side of the knob part 11. It is preferable that the auxiliary pad 21 is made of a rubber or a silicon. The auxiliary pad 21 can be attached to the knob part 11 using a bonding agent, or can be formed together with the door frame 5 and the knob part 11 by insert injection. The auxiliary pad 21 functions to prevent the slipping of knob part 11 more effectively, and to make the feeling of grasping the knob part 11 more favorable. Meanwhile, the outer surface of the auxiliary pad 21 can be shaped into waves to correspond to the fingers. The outer or front surface 17 of the knob has no auxiliary pad attached thereto, as can be seen in FIGS. 5, 6.

As described above, according to the present invention, since a user can grasp the knob part from both sides thereof, it is convenient to open/close the door, the feeling of grasping is favorable, and the slipping of fingers is prevented. Furthermore, since the knob part is formed in a body with the door frame, it can be manufactured easily. In particular, if an auxiliary pad is attached to the knob part, the feeling of grasping becomes more favorable and the slipping can be prevented more effectively.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A door for use in a microwave oven, comprising:

a door frame hingedly installed on a body forming a cooking chamber;

a door screen installed on a central area of the door frame;

a knob part integrally formed of one piece together with the door frame, the knob part forming a grasping hole configured so as to be capable of being grasped anywhere along the line of the door frame from both sides thereof, the grasping hole including a surface facing away from a user opening the door frame; and an auxiliary pad attached to the surface and formed of a softer material than the knob part for providing a favorable feeling in grasping the knob part.

2. The door for use in a microwave oven as claimed in claim 1, wherein the knob part is smoothly bent so as to be arc-shaped along a longitudinal direction thereof.

3. The door for use in a microwave oven as claimed in claim 1, further comprising an auxiliary pad attached to a rear side of the knob part, the auxiliary pad for providing a favorable feeling in grasping the knob part.

4. The door for use in a microwave oven as claimed in claim 1, wherein the auxiliary pad is made of a rubber.

5. The door for use in a microwave oven as claimed in claim 1, wherein the auxiliary pad is made of a silicon.

6. The door frame according to claim 1 wherein the knob part includes a front surface facing toward a user opening the door frame, the front face having no auxiliary pad attached thereto.

* * * * *